US012644381B2

(12) United States Patent
Xiao et al.

(10) Patent No.: US 12,644,381 B2
(45) Date of Patent: Jun. 2, 2026

(54) EXPERIMENTAL DEVICE AND METHOD FOR DETERMINING BLOCKAGE TYPE AND MAIN CONTROL FACTOR OF POLYMER INJECTION WELL

(71) Applicant: CHONGQING UNIVERSITY OF SCIENCE AND TECHNOLOGY, Chongqing (CN)

(72) Inventors: Qianhua Xiao, Chongqing (CN); Shijie Zhu, Chongqing (CN); Yang Wang, Chongqing (CN); Mei Xu, Chongqing (CN); Lei Liu, Chongqing (CN); Zhengqi Su, Chongqing (CN); Peixian Shao, Chongqing (CN); Na Dong, Chongqing (CN); Jiahao Li, Chongqing (CN); Ling Shi, Chongqing (CN)

(73) Assignee: CHONGQING UNIVERSITY OF SCIENCE AND TECHNOLOGY, Chongqing (CN)

( * ) Notice: Subject to any disclaimer, the term of this patent is extended or adjusted under 35 U.S.C. 154(b) by 27 days.

(21) Appl. No.: 19/019,451

(22) Filed: Jan. 13, 2025

(65) Prior Publication Data

US 2025/0314171 A1 Oct. 9, 2025

(30) Foreign Application Priority Data

Apr. 3, 2024 (CN) ..... 202410398064.5

(51) Int. Cl.
*E21B 49/00* (2006.01)

(52) U.S. Cl.
CPC ..... *E21B 49/00* (2013.01); *E21B 2200/20* (2020.05)

(58) Field of Classification Search
CPC ..... E21B 49/00; E21B 2200/20; E21B 47/00; E21B 47/06; Y02A 10/40
See application file for complete search history.

(56) References Cited

U.S. PATENT DOCUMENTS 8,151,633 B2 * 4/2012 Jamison ..... G01N 33/2823 73/54.39
9,714,896 B2 * 7/2017 Horvath Szabo .. G01N 15/0826
(Continued)

FOREIGN PATENT DOCUMENTS

CN 108643856 B 6/2020
CN 113818836 A 12/2021
WO 2019148279 A1 8/2019

OTHER PUBLICATIONS

Yang, Xinhui et al., Blockage Composition and Cause analysis of Polymer Flooding Response Well in SZ36-1 Oilfield, Contemporary Chemical Industry, 49(4): 658-663, 2020.
(Continued)

*Primary Examiner* — Freddie Kirkland, III
(74) *Attorney, Agent, or Firm* — PORUS IP LLC

(57) ABSTRACT

Embodiments of the present disclosure provide an experimental device and a method for determining a blockage type and a main control factor of a polymer injection well. The experimental device includes an injection system, a simulation system, an output collection system, and an information acquisition system. The simulation system includes a remote processor. The method comprises: obtaining a process parameter of the polymer injection well during actual construction, and a reservoir parameter corresponding to the polymer injection well; configuring the experimental device according to the process parameter and the reservoir parameter; conducting at least one of water injection development simulation, polymer injection development simulation, regulation and displacement operation simulation, and comprehensive operation simulation based on the experimental device according to the process parameter to obtain simu-
(Continued)

lation data; and determining the blockage type and the main control factor of the polymer injection well based on the simulation data.

10 Claims, 6 Drawing Sheets

(56) References Cited

U.S. PATENT DOCUMENTS

| | | | | |
|---|---|---|---|---|
| 11,203,928 | B2 * | 12/2021 | Dubs | E21B 49/00 |
| 11,761,274 | B2 * | 9/2023 | Jamison | G01N 15/02 73/152.23 |
| 12,031,412 | B2 | 7/2024 | Yao et al. | |
| 12,345,621 | B2 * | 7/2025 | Liu | G01N 15/0806 |
| 2023/0193704 | A1 * | 6/2023 | Jamison | G01N 21/90 73/152.23 |

OTHER PUBLICATIONS

Cui, Bo et al., Reason Analysis for Injection Well Clogging and the Measures to Breaking down Plugging in SZ36-1 Oil Field, Offshore Oil, 32(2): 64-70, 2012.

* cited by examiner

EXPERIMENTAL DEVICE AND METHOD FOR DETERMINING BLOCKAGE TYPE AND MAIN CONTROL FACTOR OF POLYMER INJECTION WELL

CROSS-REFERENCE TO RELATED APPLICATIONS

This application claims priority of Chinese Patent Application No. 202410398064.5, filed on Apr. 3, 2024, the entire contents of which are incorporated herein by reference.

TECHNICAL FIELD

The present disclosure generally relates to the technical field of oil and gas exploitation, and in particular to an experimental device and method for determining a blockage type and a main control factor of a polymer injection well.

BACKGROUND

In the process of oil and gas field production and development, a blockage of an injection well significantly affects the production and development results. For example, the blockage of the injection well may lead to an inability of an injection fluid to be uniformly distributed to a target formation, making the injection fluid unable to efficiently propel oil to a recovery well. As another example, the blockage of the injection well may affect the balance of injection and production in the oil field, preventing the injection fluid from entering the reservoir smoothly, and thus affecting the maintenance and regulation of reservoir pressure. Therefore, the blockage of the injection well is a problem that needs to be paid attention to and solved. But the blockage of the injection well is different for different reasons, and the most serious blockage includes a polymer-driven injection well or an injection well that carries out a profile control and displacement technology.

In order to effectively improve and solve the problem of the blockage of the injection well, many scholars have carried out research and analysis relating to the blockage mechanism, but almost all of them start the research from the analysis of the blockage composition, and determine the blockage mechanism based on the blockage composition. In fact, for a polymer injection well, a blockage caused by a polymer is a complex physicochemical process, and the analysis based on the blockage composition may only prove the final situation of the blockage from the final result while ignoring changes in the process. With the scale analysis, Yang Xinhui, Tang Hongming et al. demonstrated that the blockage composition of JZ9-3 includes hard agglomerate particles, primarily consisting of inorganic components such as iron salts, calcium salts, fluorosilicates, and fluoroaluminates, and a composite of soft and hard particles consisting of organic components (micelles formed by partially hydrolyzed acrylamide) and inorganic components (quartz, and calcium carbonate), and speculated that during a polymer displacement process, polymer molecules adsorbed clay minerals and solid suspended particles to form agglomerates with a certain capacity for deformation; polymers also cross-linked with multivalent metal cations to form organic micelle blockages; and inorganic scales formed by acidification and secondary precipitation intermingled with the heavy components of crude oil and the polymers, which aggravated the degree of reservoir blockage (Blockage Composition and Cause analysis of Polymer Flooding Response Well in SZ36-1 Oilfield [J]. Contemporary Chemical Industry, 2020, 40 (04): 658-663.). Cui Bo et al. discussed blockages in SZ36-1 from water injection quality, reservoir sensitivity, and process measures using theoretical analysis and experiments, and examined a blockage caused by the water injection quality, a blockage caused by the reservoir sensitivity, and a blockage caused by the process measures, respectively, which merely explained the possibility of the blockages instead of specifying which type of blockage is a main control factor. Blockages caused by the injection water quality include blockages caused by particle size, solid phase content, bacterial-containing concentration, scaling, oil contamination, etc.; and blockages caused by the process measures include blockages caused by injection profile control and acidification, etc. (Reason Analysis for Injection Well Clogging and the Measures to Breaking down Plugging in SZ36-1 Oilfield [J]. Offshore Oil, 2012, 32 (02): 64-70). These understandings only demonstrate a blockage type of the current well from the results of the scale samples of a single well, and do not elaborate the specific main control factor of the polymer displacement process. The analysis on the scale samples is extremely dependent on the acquisition of the scale samples, and each acquisition of the scale samples needs to go through a large number of operations, which is long and expensive in operation, and limits the scientific research on systematically analyzing the blockage type and the main control factor of the polymer injection well.

Therefore, it is desirable to provide an experimental device and a method for determining the blockage type and the main control factor of the polymer injection well.

SUMMARY

One or more embodiments of the present disclosure provide an experimental device for determining a blockage type and a main control factor of a polymer injection well. The experimental device may comprise an injection system, a simulation system, an output collection system, and an information acquisition system. The injection system may be configured to inject a fluid into the simulation system. The injection system may include a fluid container. The fluid container may include a fluid outlet. The fluid outlet may be connected with one end of a fluid injection pipe. At least one core sample tube may be connected with the other end of the fluid injection pipe. The fluid injection pipe may be provided with a control valve. The control valve may be configured to control the fluid to be injected into the at least one core sample tube. The simulation system may be configured to perform a simulation experiment. The simulation system may include the at least one core sample tube. The output collection system may be configured to collect the fluid discharged from the simulation system. The output collection system may include a fluid collection container. The fluid collection container may include a plurality of sub-containers. One of the plurality of sub-containers may be connected with one of the at least one core sample tube through a fluid collection pipe. The information acquisition system may be configured to acquire an experimental sample parameter of the at least one core sample tube during the simulation experiment. The simulation system may further include a remote processor. The remote processor may be configured to: determine a valve parameter corresponding to the control valve on the fluid injection pipe based on an initial sample parameter corresponding to the at least one core sample tube, and a container parameter corresponding to each of the plurality of sub-containers, the valve parameter being used to regulate opening and closing of the control valve.

One or more embodiments of the present disclosure provide a method for determining a blockage type and a main control factor of a polymer injection well, implemeted by an experimental device for determining a blockage type and a main control factor of a polymer injection well. The method may comprise: obtaining a process parameter of the polymer injection well during actual construction, and a reservoir parameter corresponding to the polymer injection well; configuring the experimental device according to the process parameter and the reservoir parameter; conducting a simulation experiment based on the experimental device according to the process parameter to obtain simulation data; the simulation experiment including at least one of water injection development simulation, polymer injection development simulation, regulation and displacement operation simulation, and comprehensive operation simulation; and determining the blockage type and the main control factor of the polymer injection well based on the simulation data. The experimental device may include an injection system, a simulation system, an output collection system, and an information acquisition system. The injection system may be configured to inject a fluid into the simulation system. The injection system may include a fluid container. The fluid container may include a fluid outlet. The fluid outlet may be connected with one end of a fluid injection pipe, and at least one core sample tube may be connected with the other end of the fluid injection pipe. The fluid injection pipe may be provided with a control valve. The control valve may be configured to control the fluid to be injected into the at least one core sample tube. The simulation system may be configured to perform the simulation experiment. The simulation system may include the at least one core sample tube. The output collection system may be configured to collect the fluid discharged from the simulation system. The output collection system may include a fluid collection container. The fluid collection container may include a plurality of sub-containers. One of the plurality of sub-containers may be connected with one of the at least one core sample tube through a fluid collection pipe. The information acquisition system may be configured to acquire an experimental sample parameter of the at least one core sample tube during the simulation experiment. The simulation system may further include a remote processor. The remote processor may be configured to: determine a valve parameter corresponding to the control valve on the fluid injection pipe based on an initial sample parameter corresponding to the at least one core sample tube, and a container parameter corresponding to each of the plurality of sub-containers, the valve parameter being used to regulate opening and closing of the control valve.

BRIEF DESCRIPTION OF THE DRAWINGS

The present disclosure will be further illustrated by way of exemplary embodiments, which will be described in detail by means of the accompanying drawings. These embodiments are not limiting, and in these embodiments, the same numbering indicates the same structure, wherein.

DETAILED DESCRIPTION

Figure 1:
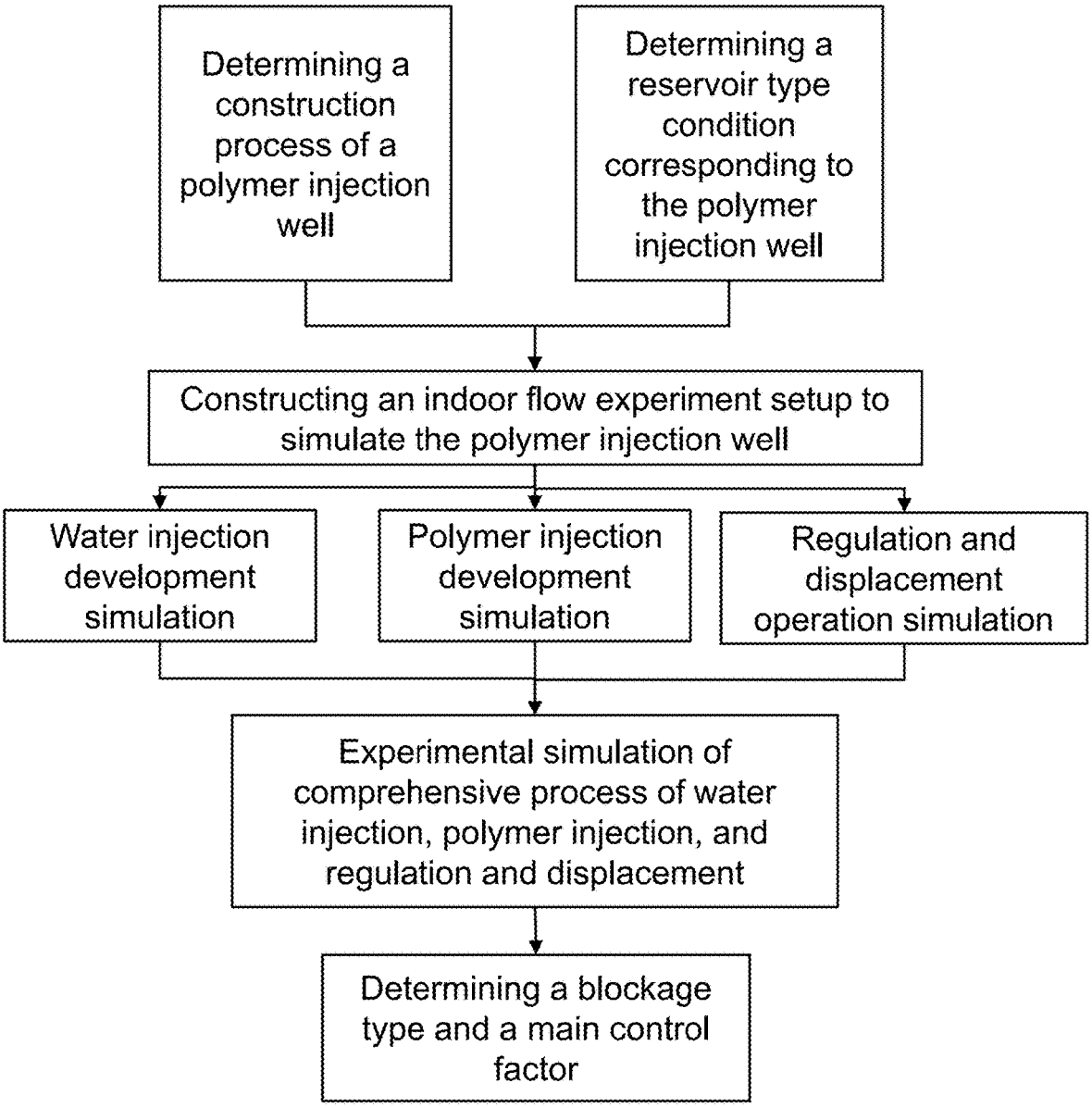
FIG. 1 is a flowchart illustrating an exemplary method for determining a blockage type and a main control factor of a polymer injection well according to some embodiments of the present disclosure.

In order to more clearly illustrate the technical solutions of the embodiments of the present disclosure, the accompanying drawings required to be used in the description of the embodiments are briefly described below. Obviously, the accompanying drawings in the following description are only some examples or embodiments of the present disclosure, and it is possible for a person of ordinary skill in the art to apply the present disclosure to other similar scenarios in accordance with these drawings without creative labor. Unless obviously obtained from the context or the context illustrates otherwise, the same numeral in the drawings refers to the same structure or operation.

It should be understood that the terms "system", "device", "unit" and/or "module" used herein are a way to distinguish between different components, elements, parts, sections, or assemblies at different levels. However, the terms may be replaced by other expressions if other words accomplish the same purpose.

Flowcharts are used in the present disclosure to illustrate the operations performed by a system according to embodiments of the present disclosure, and the related descriptions are provided to aid in a better understanding of the magnetic resonance imaging method and/or system. It should be appreciated that the preceding or following operations are not necessarily performed in an exact sequence. Instead, steps can be processed in reverse order or simultaneously. Also, it is possible to add other operations to these processes or to remove a step or steps from these processes.

The impact of a blockage of an injection well on the production and development results is significant, which not only affects the oil and gas recovery rate, but also may affect whether injection and production are successful. In addition, the means of blockage removal also varies greatly according to different blockage types of injection and production and main control factors. Accordingly, determining the blockage type and the main control factor becomes a key to blockage removal. Determining the blockage type using scale samples is most common in the prior art, but using the scale samples relies on the sampling quality of the scale samples and has a long sampling time and is costly. In addition, the scale samples may only be used to determine the blockage type, and may be difficult to determine the main control factor of the blockage, so the technical support for blockage removal is not good. In this regard, the present disclosure provides a method for determining a blockage type and a main control factor of a polymer injection well. The method is implemeted based on an experimental device for determining a blockage type and a main control factor of a polymer injection well.

The method may include: obtaining a process parameter of the polymer injection well during actual construction, and a reservoir parameter corresponding to the polymer injection well; configuring the experimental device according to the process parameter and the reservoir parameter, the experimental device being used to simulate a process of the polymer injection well during the actual construction in a laboratory setting; conducting a simulation experiment based on the experimental device according to the process parameter to obtain simulation data; the simulation experiment including at least one of water injection development simulation, polymer injection development simulation, regulation and displacement operation simulation, and comprehensive operation simulation; and determining the blockage type and the main control factor of the polymer injection well based on the simulation data.

The experimental device may include an injection system, a simulation system, an output collection system, and an information acquisition system. The injection system may be configured to inject a fluid into the simulation system. The output collection system may be configured to collect the fluid discharged from the simulation system. The simulation system may be configured to perform the simulation experiment. The simulation system may include a constant temperature and pressure box (also be referred to as a constant temperature box) and at least one core sample tube accommodated in the constant temperature and pressure box. For example, at least four core sample tubes may be provided in the constant temperature and pressure box, and opening and closing of each of the at least four core sample tubes for injecting and discharging the fluid may be controlled separately. The information acquisition system may be configured to acquire an experimental sample parameter of the at least one core sample tube during the simulation experiment.

The process parameter of the polymer injection well during the actual construction may be obtained based on construction records of the reservoir to provide a basis for the design of an injection parameter. The process parameter may include at least one of a well completion type, operation data, and a fluid parameter.

The well completion type may include any one of perforated completion, open hole completion, perforated gravel pack completion, and perforated wire wrapped screen pack completion.

Different completion ways cause changes in the seepage pattern of the injected fluid in the vicinity of the wellbore. Therefore, a suitable planar radial flow model is selected according to the different completion ways for subsequent design of an injection flow velocity and a flow rate adjustment range of the fluid.

In some embodiments, a planar radial flow equation may be determined based on the planar radial flow model; and the planar radial flow model may be determined based on the well completion type.

In response to determining that the well completion type is the perforated completion, the planar radial flow model may be expressed as:

$$v = \frac{Q}{2C\pi hn} \cdot \frac{1}{r} \tag{1}$$

In response to determining that the well completion type is the open hole completion, the planar radial flow model may be expressed as:

$$v = \frac{Q}{2C\pi h} \cdot \frac{1}{r} \tag{2}$$

In response to determining that the well completion type is the perforated wire wrapped screen pack completion, the planar radial flow model may be expressed as:

$$v = \frac{Q}{2C\pi hn} \cdot \frac{1}{r} \tag{3}$$

wherein Q denotes the flow rate in $m^3/(m \cdot d)$; C denotes an opening degree in %; h denotes a total thickness of an oil layer in m; n denotes a perforation hole density in a count of holes; r denotes a distance the fluid travels in m; v denotes a seepage velocity in m/d.

In some embodiments, the operation data may also be referred to as a development process. The development process may include different development stages and the injection parameters. The injection parameters may include a fluid type of the injected fluid. By specifying the development stage and the fluid type of the injected fluid, an indoor simulation parameter (also referred to as a simulation experiment parameter) may be better determined. The development stage may include any of a water injection development stage, a polymer injection development stage, and a regulation and displacement operation stage (also referred to as a regulation and displacement stage).

The fluid type of the injected fluid in each development stage may be based on the fluid type of an actual injected fluid. For example, the injected fluid of the water injection development stage is usually formation water, or the like; a polymer system injected in the polymer injection development stage may be a hydrophilic polymer system, or may be a lipophilic polymer system; the fluid injected in the regulation and displacement operation stage may be a gel profile control system, a resin profile control system, a weak gel profile control system, or the like. In addition, in the water injection development stage or the polymer injection development stage, a regulation and displacement agent may be added. The addition of the regulation and displacement agent may also be considered when the indoor simulation parameter is determined.

The injection parameters may further include an injection amount and an injection velocity of the injected fluid. For example, a first stage is a water injection development stage of 3-5 years, with a daily injection amount of 120 $m^3$/d, and a second stage is a polymer injection development stage of 4-5 years, with a daily injection amount of 70 $m^3$/d.

The above fluid type, the injection velocity and the injection amount of the injected fluid may be substituted into the corresponding planar radial flow models described above according to the different well completion types, such that range values of the injection velocity and the injection amount may be determined for the simulation experiment when the fluid is injected using the at least one core sample tube.

The fluid injected in the at least one core sample tube used for the simulation experiment may have similar or the same fluid parameter as the fluid used in the actual construction process. The fluid parameter may include, but not limited to, a formulation, a viscosity, and a rheological parameter of the injected fluid.

The fluid parameter of the fluid injected during the water injection development stage, such as the formation water, includes a material composition, an apparent viscosity, etc. of the formation water. The fluid parameter of the polymer system injected during the polymer injection development stage includes a type of the polymer system, the rheological parameter, etc. The fluid parameter of the regulation and displacement agent injected during the regulation and displacement stage includes a type of the regulation and displacement agent, the rheological parameter, etc.

The reservoir parameter corresponding to the polymer injection well may include at least one of an actual particle composition, an actual porosity, an actual permeability, an actual reservoir temperature, and an actual reservoir pressure. The reservoir parameter may be obtained based on well logging data, etc. The actual particle composition may further include a clay mineral composition and a range of particle sizes of rock particles, etc.

The process of filling to form a core sample may be performed based on the actual particle composition, the actual porosity, and the actual permeability in the reservoir parameter, such that a reservoir particle composition, a porosity, and a permeability of the at least one core sample tube formed infinitely approximate the actual particle composition, the actual porosity, and the actual permeability, thereby enhancing simulation effectiveness.

For example, the core sample is formed by sand filling, a sand filling material used is determined based on the actual particle composition, a difference between the permeability of the core sample and the actual permeability is not greater than 5% of the actual permeability, and a difference between the porosity of the core sample and the actual porosity is not greater than 5% of the actual porosity.

In some embodiments, the at least one core sample tube may include a housing. An accommodation chamber may be disposed in the housing. The core sample may be disposed in the accommodation chamber. An injection port may be disposed on one side of the housing for injecting the fluid, and a collection port may be disposed on the other side of the housing for discharging the fluid.

A structure of the housing may be set as desired. In some embodiments, the structure of the housing may be cubic or cylindrical.

A thickness of the housing may be set as desired. In some embodiments, the thickness of the housing may not be less than 5 mm.

A material of the housing may be set as desired. For example, the material of the housing may include stainless steel. In some embodiments, the material of the shell may include transparent and high-strength glass, which facilitates observation of the fluid flowing in the housing.

In some embodiments, the fluid injected in the water injection development simulation may be the formation water; a flow rate and a flow velocity of the formation water may be determined based on the fluid type of the fluid injected during the water injection development stage through the planar radial flow equation; and a formulation, a viscosity, and a rheological parameter of the formation water may be determined based on the fluid parameter of the water injection development stage.

In some embodiments, the fluid injected in the polymer injection development simulation may be the polymer system including a polymer; a flow rate and a flow velocity of the polymer system may be determined based on the fluid type of the fluid injected during the polymer injection development stage through the planar radial flow equation; and a formulation, a viscosity and a rheological parameter of the polymer system may be determined based on the fluid parameter of the polymer injection development stage.

In some embodiments, the fluid injected in the regulation and displacement operation simulation may be a regulation and displacement agent system; a flow rate and a flow velocity of the regulation and displacement agent system may be determined based on the fluid type of the fluid injected during the regulation and displacement stage through the planar radial flow equation; and a formulation, a viscosity and a rheological parameter of the regulation and displacement agent system may be determined based on the fluid parameter of the regulation and displacement stage.

In some embodiments, conducting the simulation experiment based on the experimental device according to the process parameter may include the following content.

A fluid injection port and a fluid discharge port of a first core sample tube may be kept to be opened, and fluid injection ports and fluid discharge ports of remaining core sample tubes of the at least one core sample tube may be kept to be closed. The formation water may be injected into the first core sample tube based on a first experimental parameter to obtain a first permeability of the core sample at the first experimental parameter. The first experimental parameter may include a plurality of first parameters, and one of the first parameters may include an injection velocity and an injection flow rate of the formation water. The first core sample tube may be a core sample tube for injecting the formation water.

A fluid injection port and a fluid discharge port of a second core sample tube may be kept to be opened, and fluid injection ports and fluid discharge ports of remaining core sample tubes of the at least one core sample tube may be kept to be closed. The polymer system may be injected into the second core sample tube based on a second experimental parameter to obtain a second permeability of the core sample at the second experimental parameter. The second experimental parameter may include a plurality of second parameters, and one of the second parameters may include an injection velocity and an injection flow rate of the polymer system. The second core sample tube may be a core sample tube for injecting the polymer system.

A fluid injection port and a fluid discharge port of a third core sample tube may be kept to be opened, and fluid injection ports and fluid discharge ports of remaining core sample tubes of the at least one core sample tube may be kept to be closed. The regulation and displacement agent system may be injected into the third core sample tube based on a third experimental parameter to obtain a third permeability of the core sample at the third experimental parameter. The third experimental parameter may include a plurality of third parameters, and one of the third parameters may include an injection velocity and an injection flow rate of the regulation and displacement agent system. The third core sample tube may be a core sample tube for injecting the regulation and displacement agent system.

A fluid injection port and a fluid discharge port of a fourth core sample tube may be kept to be opened, and fluid injection ports and fluid discharge ports of remaining core sample tubes of the at least one core sample tube may be kept to be closed. The formation water, the polymer system, and the regulation and displacement agent system may be injected into the fourth core sample tube in sequence based on the first experimental parameter, the second experimental parameter, and the third experimental parameter. The formation water may be injected again to obtain a fourth permeability of the core sample before and after each fluid injection. The fourth core sample tube may be a core sample tube for injecting a plurality of fluids.

In some embodiments, four core sample tubes may be provided in the constant temperature box. For example, the four core sample tubes may be labeled as a tube A, a tube B, a tube C, and a tube D. An injection port of each of the four core sample tubes may be connected with a fluid injection pipe, and the fluid injection pipe may be provided with a control valve configured to control the fluid to be injected into each of the four core sample tubes. Merely by way of example, the fluid injection pipe connected with the tube A may be provided with a valve A, the fluid injection pipe connected with the tube B may be provided with a valveB, the fluid injection pipe connected with the tube C may be provided with a valve C, and the fluid injection pipe connected with the tube D may be provided with a valve D.

A collection port of each of the four core sample tubes may be connected with a fluid collection pipe. In some embodiments, the fluid collection pipe may be provided with a back pressure valve configured to control a pressure of each of the four core sample tubes during liquid injection and liquid collection, respectively. In addition, each of the four core sample tubes may be provided with a pressure sensor for collecting a pressure within the core sample tube. All the core sample tubes may be placed in device capable of regulating the temperature (e.g., the constant temperature box) for regulating a simulated temperature.

In the simulation process, firstly the valves A, B, C, and D may be kept to be closed, and the back pressure valves may also be closed. The temperature of the constant temperature box may be regulated to keep the temperature constant within a range of ±2° C. of the simulated temperature. Then the valves B, C, D and the back pressure valves may be kept to be closed, the valve A may be opened, the fluid (e.g., the formation water) may be injected into the tube A, and the pressure in the tube A may be collected. When the pressure rises to a desired pressure, the back pressure valves may be opened to discharge the fluid, and the permeability of the core sample at the flow velocity may be determined after the injection of the fluid. The flow velocity of the injected fluid may be adjusted, and the above operations may be repeated to determine the first permeability of the core sample at different flow velocities.

The valve A may be closed, the valves A, B, C, and D may be kept to be closed, and all the back pressure valves may be closed. The valves A, C, D, and the back pressure valves may be closed at the same temperature, the valve B may be opened, and the fluid (e.g., the polymer system) may be injected into the tube B, and the pressure in the tube B may be collected. When the pressure rises to the desired pressure, the back pressure valves may be opened to discharge the fluid, and the permeability of the core sample at the flow velocity after the injection of the fluid may be determined. The flow velocity of the injected fluid may be adjusted, and the operations may be repeated to determine the second permeability of the core sample at different flow velocities.

Then the valve B may be closed, the valves A, B, C, and D may be kept to be closed, and all the back pressure valves may be closed. The valves A, B, D, and the back pressure valves may be closed at the same temperature, the valve C may be opened, and the fluid (e.g., the regulation and displacement agent system) may be injected into the tube C, and the pressure in the tube C may be collected. When the pressure rises to the desired pressure, the back pressure valves may be opened to discharge the fluid, and the permeability of the core sample at the flow velocity after the injection of the fluid may be determined. The flow velocity of the injected fluid may be adjusted, and the operations may be repeated to determine the third permeability of the core sample at different flow velocities.

Then the valve C may be closed, the valves A, B, C, and D may be kept to be closed, and all the back pressure valves may be closed, and the valves A, B, C, and the back pressure valves may be closed at the same temperature. The valve D may be opened to inject the formation water into the tube D, and the pressure in the tube D may be collected. When the pressure rises to the desired pressure, the back pressure valves may be opened to discharge the fluid, and then the fluid in each stage may be injected in sequence (e.g., the polymer system, the regulation and displacement agent system, and the formation water). The permeability of the core sample at the flow velocity after the injection of all the fluids may be determined. The flow velocities of the injected fluids may be adjusted, and the operations may be repeated to determine the fourth permeability of the core sample at different flow velocities.

The permeability may be obtained by Darcy formula expressed below:

$$K = \frac{Q\mu L}{A\Delta p} \tag{4}$$

where K denotes the permeability in D; Q denotes the injection amount in $cm^3/s$; A denotes a cross-sectional area of the core in $cm^2$; Δp denotes a pressure difference between two ends of the core in MPa; u denotes the viscosity of the fluid in mPa·s; and L denotes a core length in cm.

In some embodiments, the blockage type of the polymer injection well may be determined based on a change in the permeability reflected by the first permeability, the second permeability, and the third permeability. If in the injection process of the formation water, the change in the permeability is not obvious (e.g., before and after the injection, the change in the permeability is not more than 5%), it indicates no water sensitive injection blockage. If in the injection process of the formation water, even if changing the injection velocity of the formation water, the change in the permeability is not obvious (e.g., before and after the change of the injection velocity, the change in the permeability is not more than 5%), it indicates no water sensitive or velocity sensitive injection blockage in the reservoir. If in the injection process of the formation water, the change in the permeability is obvious (e.g., before and after the injection, the change in the permeability is more than 5%), it indicates a water sensitive injection blockage; if in the injection process of the formation water, the change in the permeability is obvious (e.g., before and after the change of the injection velocity, the change in the permeability is more than 5%) if changing the injection velocity of the formation water, it indicates the water sensitive injection blockage, the velocity sensitive injection blockage, or other injection blockage in the reservoir.

Similarly, if in the injection process of the polymer system, the change in the permeability is not obvious (e.g., before and after the injection, the change in the permeability is not more than 5%), it indicates no polymer sensitive injection blockage; if in the injection process of the polymer system, even if changing the injection velocity of the polymer system, the change in the permeability is not obvious (e.g., before and after the change of the injection velocity, the change in the permeability is not more than 5%), it indicates no polymer sensitive injection blockage, velocity sensitive injection blockage of the polymer system, or other injective blockage in the reservoir. If in the injection process of the polymer system, the change in the permeability is obvious (e.g., before and after the injection, the change in the permeability is more than 5%), it indicates the polymer sensitive injection blockage. If in the injection process of the polymer system, the change in the permeability is obvious (e.g. before and after the change of the injection velocity, the change in the permeability is more than 5%) if changing the injection velocity of the polymer system, it indicates the polymer sensitive injection blockage, the velocity sensitive injection blockage of the polymer system, or other injection blockage in the reservoir.

Similarly, if in the injection process of the regulation and displacement agent system, the change in the permeability is not obvious (e.g., before and after the injection, the change in the permeability is not more than 5%), it indicates no regulation and displacement sensitive injection blockage. If in the injection process of the regulation and displacement agent system, even if changing the injection velocity of the regulation and displacement agent system, the change in the permeability is not obvious (e.g. before and after the change of the injection velocity, the change in the permeability is not more than 5%), it means no regulation and displacement sensitive injection blockage, the velocity sensitive injection blockage of the regulation and displacement agent system, or other injection blockage in the reservoir. If in the injection process of the regulation and displacement agent system, the change in the permeability is obvious (e.g., before and after the injection, the change in the permeability is more than 5%), it indicates the regulation and displacement sensitive injective blockage. If in the injection process of the regulation and displacement agent system, the change in the permeability is obvious (e.g. before and after the change of the injection velocity, the change in the permeability is more than 5%) if changing the injection velocity of the regulation and displacement agent system, it indicates the regulation and displacement sensitive injection blockage, the velocity sensitive injection blockage of the regulation and displacement agent system, or other injection blockage in the reservoir.

The main control factor may be determined through a grey correlation method based on the first permeability, the second permeability, the third permeability, and the fourth permeability.

In order to better illustrate the technical solutions of the embodiments of the present disclosure, the following is an example of a polymer injection well Y1 in an oil field. The well completion type of Y1 is the perforated completion. The development process of Y1 initially includes water injection development for 5 years, and polymer injection development for 3 years, including regulation and displacement operation. A salinity of the injected formation water is 1500 mg/L, an applied polymer concentration is 1500 mg/L (with an apparent viscosity of 30 cp), and an applied viscosity of the regulation and displacement agent system is 21042 cp. The reservoir lithology is primarily composed of gravelly coarse sandstone and medium sandstone. The grains include 20%-30% of quartz, 20%-40% of feldspar, and 20%-40% of rock fragments, mainly including intrusive rock, acidic volcanic rock, quartzite, and shale. The porosity is moderate within a range of 18%-25%. The average permeability of the reservoir is within a range of $100\times10^{-3}m^2$-$1000\times10^{-3}m^2$, primarily including kaolinite (17%) and illite or montmorillonite (5% and 4%). The temperature of the reservoir is 60° C. and the formation pressure is 14 MPa.

A water injection linear velocity is determined to be within a range of 0.1-30 mL/min, a polymer injection linear velocity is determined to be within a range of 0.5-15 mL/min, and the apparent viscosity of the polymer system is determined to be 30 cp according to the above formula (1) based on the well completion type, the development process, and other process parameter and reservoir parameter described above.

Clay and rock are prepared with the reservoir lithology described above and proportionally filled to form four core sample tubes. The four core sample tubes are disposed in the constant temperature box and connected with the corresponding fluid injection pipes and the fluid collection pipes to prepare for the simulation experiment. The temperature is increased to the reservoir temperature to construct a reservoir simulation environment for the experiment.

For example, in the water injection development process simulated by the indoor experiment, sand filling tubes B, C, and D are closed, and the simulation process is conducted through a sand filling tube A. After a long time of water displacement, the permeability is determined from different injection velocities and pressure changes, which is shown in Table 1 below. From Table 1, it can be seen that under a target reservoir condition, the injection of water impacts the reservoir. Analyzing the reduction of the permeability is not sufficient to cause complete blockage, but it is normal to conduct an evaluation of the injection well as an inefficient well.

TABLE 1

Permeabilities at different injection velocities

| | Original permeability | Permeability values at different velocities and long water displacement | | | |
|---|---|---|---|---|---|
| Velocity, mL/min | 1 | 1 | 10 | 20 | 30 |
| Permeability, mD | 1620 | 1398 | 1123 | 974 | 612 |
| Cumulative count of injected PVs | 1.8 | 25 | 20 | 42 | 60 |

For example, in the polymer injection development process simulated by the indoor experiment, the sand filling tube B is opened, and the sand filling tubes A, C, and D are closed. A real core sample from the field is used for performing a substance adsorption retention experiment, and an adsorption retention amount of 0.021 mg/g for the 1500 mg/L polymer is determined. Then a polymer adsorption concentration is determined to be 15.54 mg based on a weight (i.e., 740 g) of the sand filling tube C (with a pore volume of 147 mL). A 0.01 L polymer with a concentration of 1554 mg/L is prepared, and the polymer system is injected according to the injection velocity specified in the second experimental parameter (0.068 PV) to analyze the change in the permeability.

TABLE 2

Permeabilities at different polymer injection velocities

| / | Original permeability | Permeability value of water displacement after polymer injection |
|---|---|---|
| Velocity, mL/min | 1 | 1 |

TABLE 2-continued

| Permeabilities at different polymer injection velocities | | |
|---|---|---|
| / | Original permeability | Permeability value of water displacement after polymer injection |
| Permeability, mD | 1581 | 1165 |

For example, in the regulation and displacement operation process simulated by the indoor experiment, a real core sample from the field is used for performing a substance adsorption retention experiment, and an adsorption retention amount of 0.046 mg/g is determined. Then a polymer adsorption concentration is determined to be 34.04 mg based on a weight (i.e., 740 g) of the sand filling tube C (with a pore volume of 147 mL). A 0.01 L polymer solution with a concentration of 34.04 mg/L is then prepared, and combined with other additives to form a system. After the sand filling tube C is opened, the sand filling tubes A, B, and D are closed, and water is injected at a cumulative maximum injection velocity of 2 PV into the sand filling tube C (with a test permeability of 1132 mD), the regulation and displacement agent system is injected at the injection velocity of the regulation and displacement agent system in the third experimental parameter, subsequent water displacement is conducted at 1 mL/min, and the change in the permeability is determined by the Darcy formula. It can be seen that the permeability is decreased by 43%. It means that the application of the regulation and displacement agent system causes a certain amount of blockage.

For example, the construction process applied before and after a plurality of stages is simulated based on the indoor experiment. The experiment is conducted based on the injection velocity of 1 mL/min at the first experimental parameter, the second experimental parameter, and the third experimental parameter. First, 40 PV of water is injected, then 0.2 PV of polymer injection is performed, the regulation and displacement agent system is injected, water is injected, and so on. The change in the polymer injection pressure is observed, and the blockage is analyzed by calculating the change in the permeability using the Darcy formula (see Table 3).

TABLE 3

| Change in the permeability under various process measures | | | | |
|---|---|---|---|---|
| | Original permeability | Different process measures | | |
| Velocity, mL/min | 1 | After water injection | After polymer injection | After regulation and displacement |
| Permeability, mD | 1435 | 1235 | 954 | 402 |
| Permeability retention rate | / | 86% | 66% | 28% |

According to Tables 1-3, it can be seen that the water injection development process, the polymer development process, and the regulation and displacement operation process produce certain blockages. In the water injection development process, the water sensitive and velocity sensitive effect leads to particle transporting to cause the blockage. In the polymer injection development process, adsorption retention and particle transporting lead to the blockage, which is the same as the condition of the regulation and displacement operation. In the application process of comprehensive operation, the analysis of the decrease of the permeability using the grey correlation method shows that under the existing experimental conditions, the impact of blockage caused by the water injection operation accounts for 19.4%, the impact of blockage caused by the polymer operation accounts for 27.8%, and the impact of blockage caused by the regulation and displacement operation accounts for 52.8%.

Figure 2:
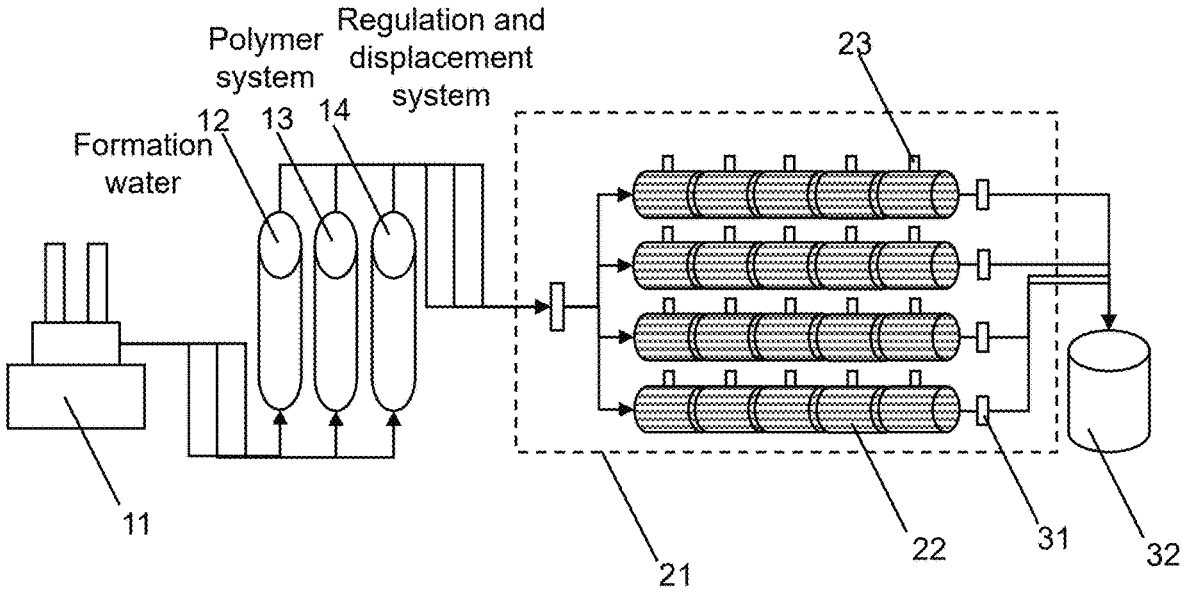
FIG. 2 is a schematic structural diagram illustrating an exemplary experimental device for determining a blockage type and a main control factor of a polymer injection well according to some embodiments of the present disclosure.

FIG. 2 is a schematic structural diagram illustrating an exemplary experimental device for determining a blockage type and a main control factor of a polymer injection well according to some embodiments of the present disclosure.

As shown in FIG. 2, the experimental device for determining the blockage type and the main control factor of the polymer injection well may include an injection system, a simulation system, an output collection system, and an information acquisition system. The injection system may be configured to inject a fluid into the simulation system. The output collection system may be configured to collect the fluid discharged from the simulation system. The simulation system may include a constant temperature box 21 and at least four core sample tubes 22 disposed in the constant temperature box 21. Opening and closing of each of the at least four core sample tubes 22 for injecting and discharging the fluid may be controlled separately. The information acquisition system may be configured to acquire an experimental sample parameter of each of the at least four core sample tubes during simulation to obtain simulation data.

In some embodiments, the injection system may include an injection pump 11 and fluid containers. The fluid containers may be connected with the injection pump 11 and configured to store the fluid. Each of the fluid containers may include a formation water container 12, a polymer system container 13, and a regulation and displacement system container 14. The injection pump 11 may be connected with each of the fluid containers to provide an injection pressure. Each of the fluid containers may be connected with a fluid injection pipe connected with each of the at least four core sample tubes. Each fluid injection pipe may be provided with a control valve.

In some embodiments, each of the fluid containers may include a fluid outlet. The fluid outlet may be connected with one end of the fluid injection pipe. At least one core sample tube may be connected with the other end of the fluid injection pipe.

In some embodiments, the output collection system may include fluid collection containers 32 for collecting the fluid discharged from each of the at least one core sample tube, and a fluid collection pipe connected with each of the fluid collection containers. Each of the fluid collection pipes may be provided with a back pressure valve 31.

In some embodiments, each of the fluid collection containers 32 may include a fluid inlet. The fluid inlet may be connected with one end of each of the fluid collection pipes; and the other end of each of the fluid collection pipes may be connected with the at least one core sample tube.

In some embodiments, the information acquisition system may include a plurality of pressure sensors 23. At least two pressure sensors 23 of the pressure sensors 23 may be provided on one of the at least one core sample tube 22.

Figure 3:
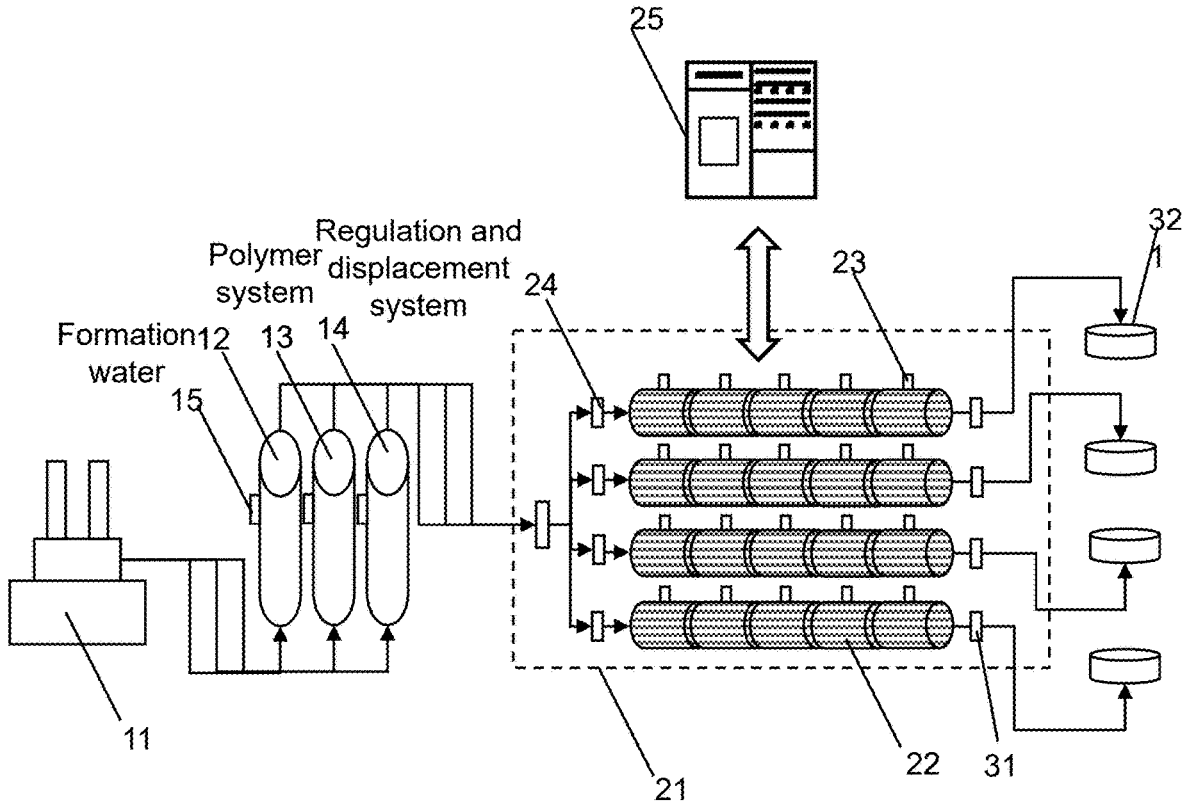
FIG. 3 is a schematic structural diagram illustrating another exemplary experimental device for determining a blockage type and a main control factor of a polymer injection well according to some embodiments of the present disclosure.

FIG. 3 is a schematic structural diagram illustrating another exemplary experimental device for determining a blockage type and a main control factor of a polymer injection well according to some embodiments of the present disclosure.

As shown in FIG. 3, in some embodiments, a fluid collection container may include a plurality of sub-containers 321. One of the plurality of sub-containers 321 may be connected with one of the at least one core sample tube 22 through a fluid collection pipe.

The plurality of sub-containers refer to devices for collecting the fluid discharged from the at least one core sample tube. In some embodiments, the plurality of sub-containers may be configured to acquire the fluid discharged from the at least one core sample tube through the fluid collection pipe. The plurality of sub-containers may be fluid tanks or other devices capable of collecting the fluid.

In some embodiments, the fluid injection pipe may be provided with the control valve. The control valve may be configured to control the fluid to be injected into the at least one core sample tube.

In some embodiments, the simulation system may further include a remote processor 25. The remote processor 25 may be various common general-purpose central processing units (CPUs), microprocessors, application-specific integrated circuits (ASICs), or other types of integrated circuits. The remote processor 25 may be configured to process various data and/or information related to a simulation experiment and execute program instructions based on the data, information, and/or processing results to perform one or more functions described in the present disclosure.

The remote processor 25 may determine a valve parameter corresponding to the control valve on the fluid injection pipe based on an initial sample parameter corresponding to the at least one core sample tube, and a container parameter corresponding to each of the plurality of sub-containers.

The initial sample parameter refers to a parameter that characterizes a core sample prior to conducting the simulation experiment. In some embodiments, the initial sample parameter may include at least one of an initial porosity and an initial permeability.

In some embodiments, the initial sample parameter may be determined based on user input.

The container parameter refers to a parameter that characterizes the sub-containers in the injection system. In some embodiments, the container parameter may include a size of one of the sub-containers, a core sample tube to which one of the sub-containers is connected, etc.

In some embodiments, the container parameter may be determined based on user input.

The valve parameter refers to data that characterizes an opening degree of the valve. In some embodiments, the valve parameter may include an opening degree of at least one valve.

In some embodiments, the remote processor 25 may send the initial sample parameter and the container parameter to a user and determine the valve parameter based on an input of the user. The user may determine the valve parameter based on the initial sample parameter, and the container parameter, and the purpose of the experiment based on experience.

In some embodiments, the simulation system may further include at least one fluid reservoir 24. The at least one fluid reservoir 24 may be connected with the fluid injection pipe and the at least one core sample tube, respectively.

In some embodiments, the remote processor 25 may determine the valve parameter based on the initial sample parameter, the container parameter, and a fluid reservoir parameter corresponding to the at least fluid reservoir.

The at least one fluid reservoir refers to a device used for temporarily storing the fluid entering the simulation system.

The fluid reservoir parameter refers to data that characterizes the at least one fluid reservoir. In some embodiments, the fluid reservoir parameter may include a size of the at least one fluid reservoir, the fluid injection pipe and the core sample tube to which the at least one fluid reservoir is connected, etc.

In some embodiments, the fluid reservoir parameter may be determined based on user input.

In some embodiments, the remote processor may send the initial sample parameter, the container parameter, and the fluid reservoir parameter to the user and determine the valve parameter based on the input of the user. The user may determine the valve parameter based on the initial sample parameter, the container parameter, and the fluid reservoir parameter, and the purpose of the experiment based on experience.

In the actual exploitation process, the temperature of the fluid increases with the depth of injection. During the simulation experiment, due to a close distance between the injection system and the simulation system, the simulation experimental device is unable to restore the temperature increasing process of the fluid only through the constant temperature and pressure box in the simulation system, which prevents the temperature of the fluid injected into the at least one core sample tube from reaching an ideal state.

In some embodiments of the present disclosure, by providing the at least one fluid reservoir, the temperature of the fluid is increased in the constant temperature and pressure box before injecting of the fluid into the at least one core sample tube, such that the temperature of the fluid during the actual exploitation process can be better reproduced, and thus the simulation experiment can be more accurately conducted.

In some embodiments, the remote processor may control opening and closing of the control valve corresponding to at least one fluid injection pipe based on the valve parameter input by the user.

In some embodiments of the present disclosure, by opening the valves of a plurality of fluid injection pipes simultaneously, the simulation experiment of the at least one core sample tube is conduct simultaneously, which enhances the efficiency of conducting the simulation experiment.

Figure 4:
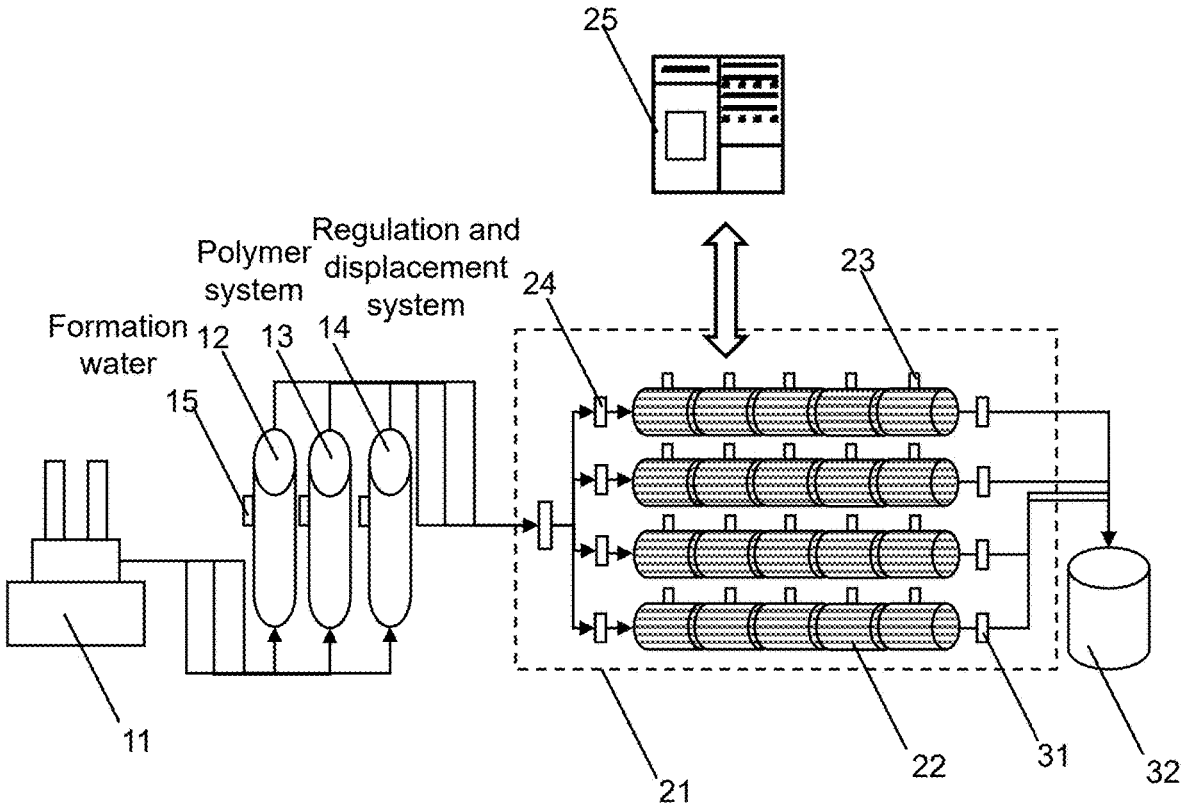
FIG. 4 is a schematic structural diagram illustrating another exemplary experimental device for determining a blockage type and a main control factor of a polymer injection well according to some embodiments of the present disclosure.

FIG. 4 is a schematic structural diagram illustrating another exemplary experimental device for determining a blockage type and a main control factor of a polymer injection well according to some embodiments of the present disclosure.

As shown in FIG. 3 and FIG. 4, in some embodiments, the injection system may further include a temperature regulation device 15. The temperature regulation device 15 may be configured to regulate a temperature of the fluid in the injection system based on a temperature regulation parameter.

The temperature regulation device 15 refers to a device for regulating the temperature of the fluid. In some embodiments, the temperature regulation device 15 may be disposed in the formation water container 12, the polymer system container 13, and the regulation and displacement system container 14 to implement temperature regulation of formation water, a polymer system, and a regulation and displacement agent system.

Figure 5:
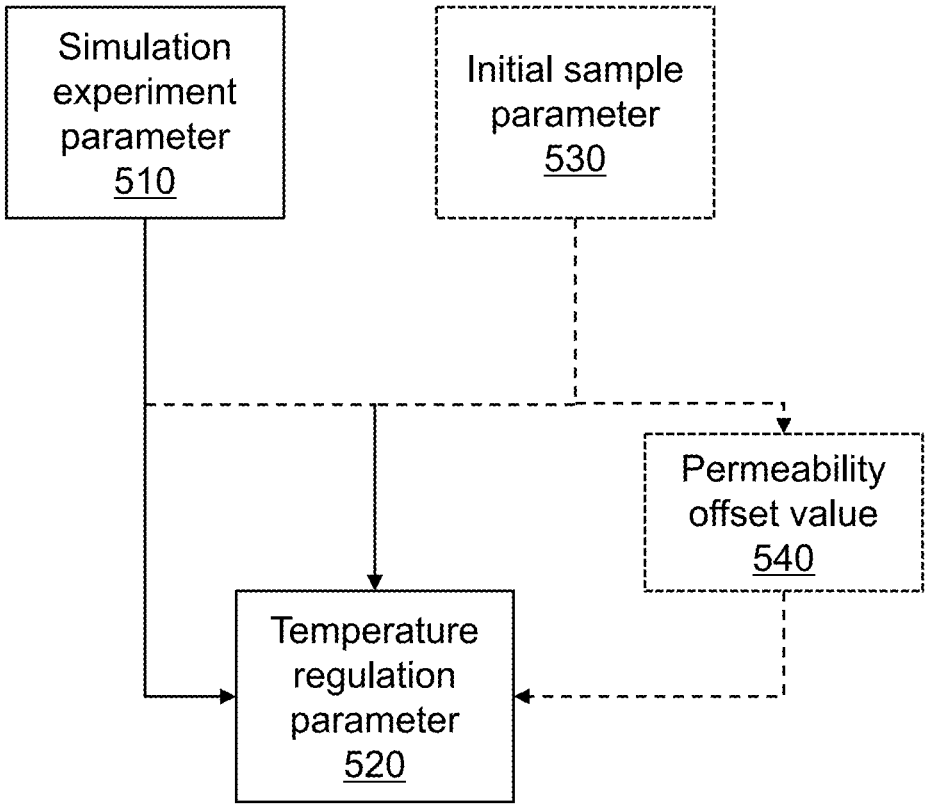
FIG. 5 is a schematic diagram illustrating a process for determining a temperature regulation parameter according to some embodiments of the present disclosure.

FIG. 5 is a schematic diagram illustrating a process for determining a temperature regulation parameter according to some embodiments of the present disclosure. As shown in FIG. 5, the process for determining the temperature regulation parameter may include the following operations. The process may be performed by the remote processor 25.

In some embodiments, the remote processor 25 may be configured to: determine a temperature regulation parameter 520 based on a simulation experiment parameter 510.

The simulation experiment parameter refers to an experimental condition that is set to achieve an experimental objective in a simulation experiment. In some embodiments, the simulation experiment parameter may include a formation temperature, a formation depth, or other parameters characterizing a formation or an experimental environment that the simulation experiment needs to simulate.

In some embodiments, the simulation experiment parameter may be obtained based on user input.

The temperature regulation parameter refers to a parameter used to regulate a temperature of a fluid in each of containers in an injection system during the simulation experiment. In some embodiments, the temperature regulation parameter may include a temperature corresponding to at least one temperature regulation device.

In some embodiments, the remote processor 25 may determine the temperature regulation parameter based on the simulation experiment parameter by querying a first reference temperature table. The first reference temperature table may include at least one fluid and a corresponding reference temperature of the at least one fluid in different formation environments.

In some embodiments, the first reference temperature table may be determined from actual exploitation data. For example, the remote processor 25 may acquire the formation temperature and the formation depth corresponding to a reservoir, a fluid type, and the temperature of the fluid when arriving at the reservoir during the actual exploitation process. The formation temperature and the formation depth corresponding to the reservoir may be determined as the formation environment, and the temperature of the fluid when arriving at the reservoir may be determined as a reference temperature, and the formation environment, the fluid type, and the corresponding reference temperature may be recorded in the first reference temperature table.

In some embodiments, the remote processor 25 may determine the temperature regulation parameter by querying the first reference temperature table based on the formation temperature and the formation depth to be simulated in the simulation experiment parameter, and the fluid type of the fluid to be injected.

In some embodiments, the remote processor 25 may send the temperature regulation parameter to the temperature regulation device 15 to control the temperature regulation device 15 to regulate the temperature of the fluid in the at least one container in the injection system.

In the actual exploitation process, due to the large depth of the reservoir, the injected fluid has a temperature change as the depth increases. In some embodiments of the present disclosure, by determining the temperature regulation parameter and controlling the temperature regulation device to regulate the temperature of the fluid based on the temperature regulation parameter, the temperature of the fluid injected into the core sample tube can be more consistent with the actual exploitation condition, such that the process of the simulation experiment is more in line with the actual situation, thereby better guaranteeing the accuracy of the simulation experiment.

In some embodiments, the remote processor 25 may be further configured to: determine the temperature regulation parameter 520 based on the simulation experiment parameter 510 and an initial sample parameter 530.

In some embodiments, the remote processor 25 may determine the temperature regulation parameter by querying a second reference temperature table based on the simulation experiment parameter and the initial sample parameter. The second reference temperature table may include at least one fluid and a corresponding reference temperature of the at least one fluid in different formation environments and different formation parameters.

The second reference temperature table may be determined in a similar process as the first reference temperature table. The second reference temperature table may further include a formation parameter corresponding to the reservoir during the actual exploitation process. The formation parameter characterizes an actual permeability and an actual porosity of the reservoir in the actual exploitation process.

In actual exploitation process, features of the reservoir may also have an effect on the temperature. In some embodiments of the present disclosure, by further considering the features of the core sample, the actual situation can be simulated in a more comprehensive manner, so as to make the results of the simulation experiment more accurate.

In some embodiments, the remote processor 25 may determine a permeability offset value 540 based on the simulation experiment parameter 510 and the initial sample parameter 530; and determine the temperature regulation parameter 520 based on the permeability offset value 540.

The permeability offset value refers to a difference between a permeability of the core sample and a permeability in a real condition.

In some embodiments, the remote processor 25 may obtain permeabilities corresponding to the reservoir at different formation temperatures and different formation depths when different fluids are injected in the actual exploitation process. For each of the fluids, the formation temperature and the formation depth may be used as independent variables, and the permeability may be used as a dependent variable to draw an image which shows a change in the permeability with the formation temperature and the formation depth, and a permeability function may be obtained by performing function fitting based on the image; the formation temperature and the formation depth to be simulated may be determined based on the simulation experiment parameter, and a theoretical permeability may be obtained by substituting the formation temperature and the formation depth to be simulated into the permeability function; and the permeability offset value may be determined based on a difference between the theoretical permeability and an initial permeability. The initial permeability may be determined based on the initial sample parameter.

In some embodiments, the remote processor 25 may determine, based on the permeability offset value, a temperature regulation value by querying a reference regulation table, the temperature regulation value characterizing a required change degree of the temperature of the fluid in the injection system; and determine the temperature regulation parameter based on the temperature regulation value and a current temperature of the fluid in the injection system. The reference regulation table may include at least one reference offset value and a corresponding reference temperature regulation value of the at least one reference offset value. In some embodiments, the reference regulation table may be determined based on at least one of the permeability function or the simulation experiment. For example, the remote processor 25 may determine, based on the permeability function, a temperature difference between different permeabilities at the same formation depth, and determine the formation depth, the difference between the different permeabilities, and the temperature difference as a single piece of data to be recorded in the reference regulation table. The remote processor 25 may determine a plurality of data in a similar manner to construct the reference regulation table.

In some embodiments of the present disclosure, the temperature regulation parameter is determined based on the permeability offset value corresponding to the core sample, such that the temperature of the fluid is increased. After the fluid is injected into the at least one core sample tube, the temperature of the core sample therein changes due to the injection of the fluid, and the permeability of the core sample is closer to the actual situation, thereby making the results of the simulation experiment more accurate.

In some embodiments, the remote processor 25 may determine a temperature regulation range of a constant temperature and pressure box based on the fluid type of the fluid injected into the simulation system, an injection rate, the permeability offset value, and the initial sample parameter.

The fluid type refers to a type of the fluid injected into the at least one core sample tube. In some embodiments, the fluid type may include at least one of formation water, a polymer system, and a regulation and displacement agent system.

The injection rate refers to an amount of the fluid injected per unit time, such as a volume, a mass, or the like, of the fluid injected per unit time.

In some embodiments, the fluid type and the injection rate may be determined based on user input.

In some embodiments, the remote processor 25 may determine the temperature regulation value of the fluid based on the permeability offset value, determine an ideal temperature to be reached by the constant temperature and pressure box based on a sum of the temperature regulation value and a current temperature of the fluid in the injection system; and determine the temperature regulation range of the constant temperature and pressure box based on the ideal temperature to be reached by the constant temperature and pressure box and a temperature tolerance. The temperature tolerance characterizes a permissible value that the actual temperature of the constant temperature and pressure box deviates from the ideal temperature. The temperature tolerance may be determined based on prior experience. For example, if the ideal temperature is $T_0$ and the temperature tolerance is $\Delta T$, the temperature regulation range is $(T_0-\Delta T, T_0+\Delta T)$.

In some embodiments of the present disclosure, by the constant temperature and pressure box, the temperature of the fluid to be injected into the at least one core sample tube in the simulation system and the temperature of the at least one core sample tube can be further regulated, such that the temperature of the fluid to be injected into the at least one core sample tube in the simulation system and the temperature of the at least one core sample tube can be more in line with the actual situation, and the permeability of the core sample can also be maintained at a more realistic level due to the change in temperature, thereby better guaranteeing the accuracy of the simulation experiment.

Figure 6:
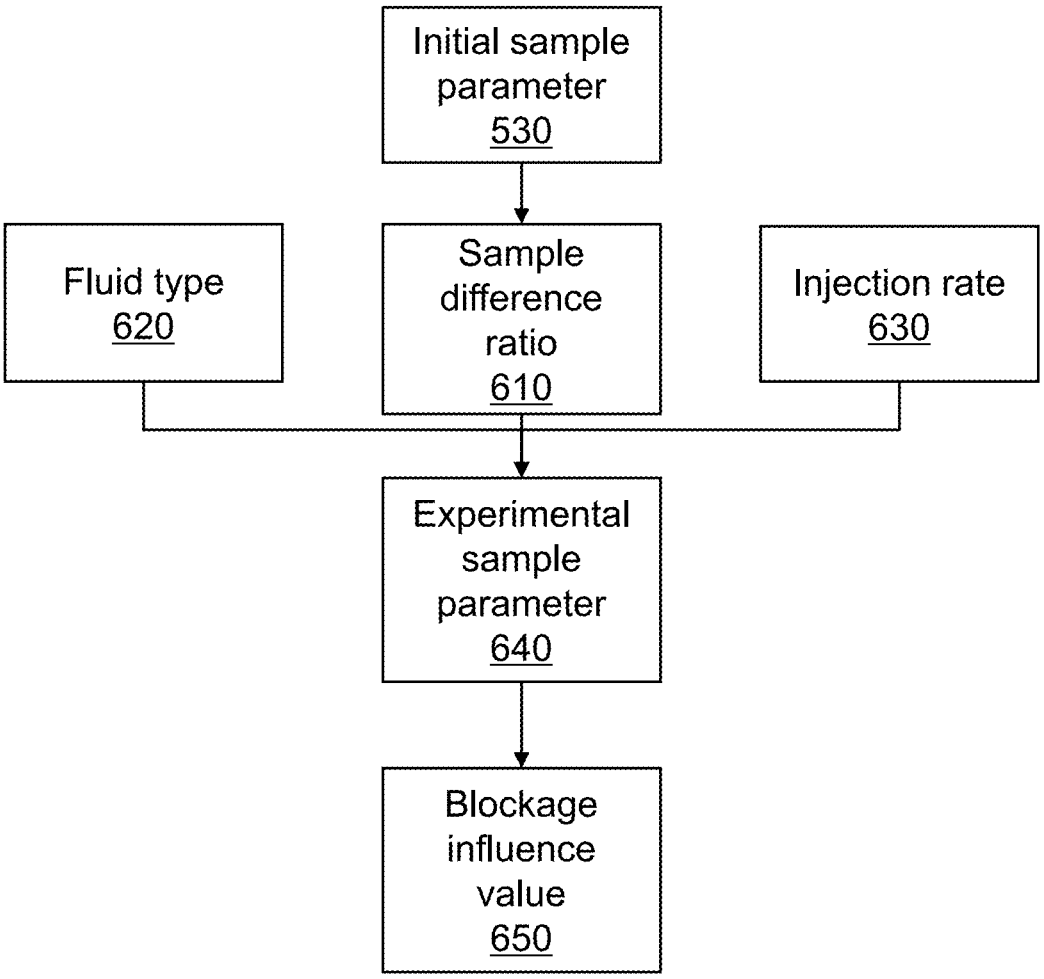
FIG. 6 is a schematic diagram illustrating a process for determining a blockage influence value according to some embodiments of the present disclosure.

FIG. 6 is a schematic diagram illustrating a process for determining a blockage influence value according to some embodiments of the present disclosure. As shown in FIG. 6, the process for determining the blockage influence value may include the following content. The process may be performed by a remote processor.

In some embodiments, the remote processor 25 may determine a sample difference ratio 610 of a core sample in at least one core sample tube based on the initial sample parameter 530 corresponding to the at least one core sample tube; determine an experimental sample parameter 640 of the core sample based on the sample difference ratio 610, a fluid type 620 of a fluid injected into a simulation system, and an injection rate 630; and determine a blockage influence value 650 corresponding to at least one fluid based on the experimental sample parameter 640.

The sample difference ratio refers to data that characterizes a difference between the core sample and an actual formation. The higher the sample difference ratio, the greater the difference between the core sample and the actual formation.

In some embodiments, the sample difference ratio may include at least one of a porosity difference ratio and a permeability difference ratio.

The porosity difference ratio characterizes a difference in porosity between the core sample and the actual formation prior to conducting the simulation experiment. In some embodiments, the remote processor may determine the porosity difference ratio based on a ratio of a difference between an initial porosity corresponding to the core sample and a porosity corresponding to the actual formation to the porosity corresponding to the actual formation. The difference is an absolute value.

The permeability difference ratio characterizes a difference in permeability between the core sample and the actual formation before conducting the simulation experiment. In some embodiments, the remote processor may determine the permeability difference ratio based on a ratio of a difference between an initial permeability corresponding to the core sample and a permeability corresponding to the actual formation to the permeability corresponding to the actual formation. The difference is an absolute value.

In the process of conducting the simulation experiment, the porosity and the permeability of the core sample may change due to the influence of an operation mode, a temperature, and other factors. The experimental sample parameter refers to a feature of the core sample during the simulation experiment. In some embodiments, the experimental sample parameter may include at least one of an experimental porosity and an experimental permeability.

In some embodiments, the remote processor 25 may determine the experimental sample parameter of the core sample by matching in a vector database based on the sample difference ratio, the fluid type of the fluid injected into the simulation system, and the injection rate.

The vector database may include at least one reference vector and a corresponding reference sample parameter of the at least one reference vector.

In some embodiments, the remote processor 25 may construct at least one clustering vector based on at least one historical core sample in historical data. For example, for one of the at least one historical core sample, the remote processor may construct the clustering vector based on a historical sample difference ratio in a historical simulation experiment, a corresponding historical fluid type, a historical injection rate, and a historical sample parameter of a historical core sample during the historical simulation experiment.

The remote processor may cluster the at least one clustering vector to form a preset count of clustering centers, construct at least one reference vector based on the historical sample difference ratio, the historical fluid type, and the historical injection rate corresponding to each of the clustering centers, and determine a historical sample parameter corresponding to at least one of the clustering centers as a label of the corresponding reference vector, i.e., the reference sample parameter.

In some embodiments, the remote processor 25 may construct a feature vector of the core sample based on the sample difference ratio, the fluid type of the fluid injected into the simulation system, and the injection rate, perform matching in the vector database based on the feature vector to determine a reference vector with the highest similarity to the feature vector, and determine a label of the reference vector as an experimental sample feature corresponding to the core sample. The similarity may be determined based on a vector distance. The smaller the vector distance, the higher the similarity.

In some embodiments, the remote processor 25 may determine the experimental sample parameter through a parameter prediction model based on the sample difference ratio, the fluid type of the fluid injected into the simulation system, and the injection rate.

In some embodiments, the parameter prediction model may be a machine learning model, such as a deep neural networks (DNN) models, or other trained machine learning models.

An input of the parameter prediction model may include the sample difference ratio, the fluid type of the fluid injected into the simulation system, and the injection rate, and an output of the parameter prediction model may include the experimental sample parameter.

More descriptions regarding the input and the output of the parameter prediction model may be found in the related descriptions of the present disclosure above.

In some embodiments, the parameter prediction model may output the experimental sample parameter corresponding to one core sample at a time, or may output the experimental sample parameters corresponding to a plurality of core samples simultaneously.

In some embodiments, the parameter prediction model may be obtained by training based on a plurality of training samples with labels through gradient descent or other feasible means.

In some embodiments, the training samples and the corresponding labels may be determined based on the historical data. The training samples may include the historical sample difference ratio, the historical fluid type, and the historical injection rate corresponding to the at least one historical core sample in the historical data, and the labels may include the historical sample parameter obtained by subsequent sampling and testing of the at least one historical core sample in the historical data.

In some embodiments, the input of the parameter prediction model may further include at least one of a temperature regulation parameter and a temperature regulation range of a constant temperature and pressure box.

If the input of the parameter prediction model further includes at least one of the temperature regulation parameter and the temperature regulation range of the constant temperature and pressure box, the training samples for model training may correspondingly include at least one of a historical temperature regulation parameter and a historical temperature regulation range. The historical temperature regulation parameter and the historical temperature regulation range may be determined based on parameters used in conducting the historical simulation experiment in the historical data.

In the process of conducting the simulation experiment, the temperature regulation range of the constant temperature and pressure box, and the temperature of the fluid also affect the core sample, causing a change in the porosity and the permeability. In some embodiments of the present disclosure, by considering the temperature regulation parameter and the temperature regulation range of the constant temperature and pressure box, the prediction process of the parameter prediction model is more in line with the process of the simulation experiment, thereby making the output of the parameter prediction model more accurate.

In some embodiments of the present disclosure, by the parameter prediction model, the consumption of time for conducting the simulation experiment can be reduced, and the dependence on the experimental environment and human resources can be reduced, thereby more efficiently determining the experimental sample parameter of the core sample in the process of the simulation experiment. The parameter prediction model obtained through training can capture subtle changes that may not be noticed in the simulation experiment, thereby improving the accuracy and reliability of the prediction results.

The blockage influence value refers to an influence degree of the fluid on the blockage of a polymer injection well. The greater the blockage influence value corresponding to the fluid, the more likely the fluid is to cause the blockage of the polymer injection well.

In some embodiments, the blockage influence value of the fluid may be measured by at least one of a flow velocity of the fluid, a change in oil production, and a flow resistance in the polymer injection well. For example, the greater the decrease in the flow velocity of the fluid with respect to the start of exploitation, the greater the blockage influence value of the fluid; the greater the decrease in the oil production per unit time with respect to the start of exploitation, the greater the blockage influence value of the fluid; and the larger the increase in the flow resistance in the polymer injection well with respect to the start of exploitation, the larger the blockage influence value of the fluid.

In some embodiments, the blockage influence value of the fluid may be determined by weighted summation based on at least one of the flow velocity of the fluid, the change in the oil production, and the flow resistance in the polymer injection well. A weight of the weighted summation may be related to a validity of the data. The higher the validity of the data, the higher the weight of the weighted summation.

In some embodiments, the remote processor 25 may determine the blockage influence value corresponding to the at least one fluid based on the experimental sample parameter of the at least one core sample.

Merely by way of example, the remote processor 25 may construct, based on exploitation data corresponding to an actual exploitation process, at least one fitting function corresponding to the at least one fluid characterizing the permeability and the blockage influence value of a reservoir in the actual exploitation process using the permeability of the reservoir as an independent variable and the blockage influence value as a dependent variable; and determine an experimental permeability based on the experimental sample parameter of the core sample, and substitute the experimental permeability into the at least one fitting function to obtain the blockage influence value of the at least one fluid on the core sample.

In some embodiments of the present disclosure, the blockage influence value corresponding to at least one fluid is determined through the fitting function based on the experimental sample parameter corresponding to the core sample during the simulation experiment, which can better reveal the pattern and trend of the data, thereby obtaining the more accurate result of the blockage influence value.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by the present disclosure and are within the spirit and scope of the exemplary embodiments of the present disclosure.

What is claimed is:

1. An experimental device for determining a blockage type and a main control factor of a polymer injection well, comprising an injection system, a simulation system, an output collection system, and an information acquisition system; wherein the injection system is configured to inject a fluid into the simulation system; the injection system includes a fluid container; the fluid container includes a fluid outlet, the fluid outlet is connected with one end of a fluid injection pipe, and the at least one core sample tube is connected with the other end of the fluid injection pipe; the fluid injection pipe is provided with a control value configured to control the fluid to be injected into the at least one core sample tube;

the simulation system is configured to perform a simulation experiment, and the simulation system includes the at least one core sample tube;

the output collection system is configured to collect the fluid discharged from the simulation system; the fluid collection container includes a fluid collection container, the fluid collection container includes a plurality of sub-containers, one of the sub-containers is connected with one of the at least one core sample tube through a fluid collection pipe; and the information acquisition system is configured to acquire an experimental sample parameter of the at least one core sample tube during the simulation experiment; wherein the simulation system further includes a remote processor, and the remote processor is configured to:

determine a valve parameter corresponding to the control valve on the fluid injection pipe based on an initial sample parameter corresponding to the at least one core sample tube, and a container parameter corresponding to each of the plurality of sub-containers, the valve parameter being used to regulate opening and closing of the control valve.

2. The experimental device of claim 1, wherein the fluid collection container includes a fluid inlet, the fluid inlet is connected with one end of the fluid collection pipe; the other end of the fluid collection pipe is connected with the at least one core sample tube.

3. The experimental device of claim 1, wherein the information acquisition system includes a plurality of pressure sensors, and at least two pressure sensors are provided on one of the at least one core sample tube.

4. The experimental device of claim 1, wherein the simulation system further includes at least one fluid reservoir, the at least one fluid reservoir is respectively connected with the fluid injection pipe and the at least one core sample tube;

the remote processor is further configured to:

determine the valve parameter based on the initial sample parameter, the container parameter, and a fluid reservoir parameter corresponding to the fluid reservoir.

5. The experimental device of claim 1, wherein the injection system further includes a temperature regulation device, the temperature regulation device is configured to regulate a temperature of the fluid in the injection system based on a temperature regulation parameter;

the remote processor is further configured to:

determine the temperature regulation parameter based on a simulation experiment parameter.

6. The experimental device of claim 5, wherein the remote processor is further configured to:

determine the temperature regulation parameter based on the simulation experiment parameter and the initial sample parameter.

7. The experimental device of claim 6, wherein the remote processor is further configured to:

determine a permeability offset value based on the simulation experiment parameter and the initial sample parameter; and determine the temperature regulation parameter based on the permeability offset value.

8. The experimental device of claim 7, wherein the remote processor is further configured to:

determine a temperature regulation range of a constant temperature and pressure box based on a fluid type of the fluid injected into the simulation system, an injection rate, the permeability offset value, and the initial sample parameter.

9. The experimental device of claim 1, wherein the initial sample parameter further includes a porosity of a core sample;

the remote processor is further configured to:

determine a sample difference ratio of the core sample in the at least one core sample tube based on the initial sample parameter corresponding to the at least core sample tube;

determine an experimental sample parameter of the core sample based on the sample difference ratio, a fluid type of the fluid injected into the simulation system, and an injection rate; and determine a blockage influence value corresponding to at least one fluid based on the experimental sample parameter.

10. The experimental device of claim 9, wherein the remote processor is further configured to:

determine the experimental sample parameter through a parameter prediction model based on the sample difference ratio, the fluid type of the fluid injected into the simulation system, and the injection rate, the parameter prediction model being a machine learning model.

* * * * *